US011692372B2

(12) United States Patent
Kellogg, II et al.

(10) Patent No.: US 11,692,372 B2
(45) Date of Patent: Jul. 4, 2023

(54) KEY SYSTEM

(71) Applicant: Magnetikeys, LLC, E. Palo Alto, CA (US)

(72) Inventors: L. Walker Kellogg, II, Palo Alto, CA (US); Benjamin E. Pearson, Newark, CA (US)

(73) Assignee: Magnetikeys, LLC, E. Palo Alto, CA (US)

( * ) Notice: Subject to any disclaimer, the term of this patent is extended or adjusted under 35 U.S.C. 154(b) by 119 days.

(21) Appl. No.: 16/883,457

(22) Filed: May 26, 2020

(65) Prior Publication Data

US 2020/0308872 A1 Oct. 1, 2020

Related U.S. Application Data

(63) Continuation of application No. PCT/US2018/062647, filed on Nov. 27, 2018.

(60) Provisional application No. 62/590,971, filed on Nov. 27, 2017.

(51) Int. Cl.

| | |
|---|---|
| ***E05B 19/04*** | (2006.01) |
| ***E05B 47/00*** | (2006.01) |
| ***A45C 11/32*** | (2006.01) |
| ***B67B 7/16*** | (2006.01) |
| ***E05B 19/00*** | (2006.01) |

(52) U.S. Cl.

CPC ..... *E05B 47/0045* (2013.01); *A45C 11/324* (2013.01); *B67B 7/16* (2013.01); *E05B 19/0052* (2013.01); *E05B 19/0082* (2013.01); *E05B 19/04* (2013.01)

(58) Field of Classification Search

CPC ..... E05B 47/0045; E05B 19/0052; E05B 19/0082; E05B 19/04; E05B 47/00; E05B 19/00; E05B 19/14; E05B 19/043; E05B 47/0038; A45C 11/324; A45C 11/32; B67B 7/16; A44B 15/00; Y10T 70/8676; Y10T 70/8784; Y10T 70/7876; Y10T 70/7859; Y10T 70/7904

USPC ..... 70/405, 408, 413, 456 R

See application file for complete search history.

(56) References Cited

U.S. PATENT DOCUMENTS

| | | | | |
|---|---|---|---|---|
| 1,649,402 A | | 11/1927 | Gildemeister | |
| 2,645,113 A | * | 7/1953 | Olsen | A45C 11/328 70/456 R |
| 3,069,890 A | * | 12/1962 | McKinney | A45C 11/325 70/456 R |
| 4,562,711 A | | 1/1986 | Fliege | |

(Continued)

FOREIGN PATENT DOCUMENTS

| | | |
|---|---|---|
| CN | 2801987 | 8/2006 |
| CN | 201835609 | 5/2011 |

(Continued)

*Primary Examiner* — Suzanne L Barrett

(74) *Attorney, Agent, or Firm* — Levine Bagade Han LLP

(57) ABSTRACT

A key comprises a body with a head and a blade and a magnet in the head. The key can be part of a key set including a plurality of keys. Each key can have a hole through the head, for example through approximately a center of the head. The key set can include a hub through the holes in the keys, such that the keys are coupled by and are rotatable around the hub. The magnets in the keys can silence, and resist, index, and lock rotation of the keys around the hub.

22 Claims, 10 Drawing Sheets

(56) References Cited

U.S. PATENT DOCUMENTS

| | | | | |
|---|---|---|---|---|
| 5,621,936 | A * | 4/1997 | Penaligon | A44B 15/005 81/3.4 |
| 6,367,297 | B1 * | 4/2002 | Mottura | E05B 47/0044 70/276 |
| 7,047,776 | B2 * | 5/2006 | Blake | E05B 19/00 70/459 |
| 10,138,655 | B2 * | 11/2018 | Borenstein | E05B 19/24 |
| 2004/0079125 | A1 | 4/2004 | Morehart et al. | |
| 2006/0086163 | A1 * | 4/2006 | Downes | A45C 11/327 70/456 R |
| 2008/0006070 | A1 | 1/2008 | Aizpurua | |
| 2015/0191937 | A1 * | 7/2015 | Piron | E05B 47/0045 70/413 |
| 2016/0369526 | A1 * | 12/2016 | Ho | E05B 19/00 |
| 2017/0234034 | A1 | 8/2017 | Borenstein | |

FOREIGN PATENT DOCUMENTS

| | | | | |
|---|---|---|---|---|
| GB | 2187227 A * | 9/1987 | | G07C 9/00738 |
| WO | WO 2019/104335 | 5/2019 | | |

* cited by examiner

KEY SYSTEM

CROSS-REFERENCE TO RELATED APPLICATIONS

This application is a continuation of International Application No. PCT/US2018/062647 filed Nov. 27, 2018 titled Key System, which claims priority to U.S. Provisional Application No. 62/590,971 filed Nov. 27, 2017 titled Key System, each of which is incorporated herein by reference in its entirety for all purposes.

BACKGROUND

(1) Field of the Disclosure

This disclosure relates to a key system, and in particular to a key system having magnets embedded in keys.

(2) Description of the Related Art

Many people carry multiple keys everywhere they go. With unique keys needed to open homes, offices, vehicles, mailboxes, drawers, and countless other spaces, the number of keys needed by a person on any given day typically requires the person to carry a set of keys at virtually all times. Typically held together by a keyring, these key sets can become unwieldy and noisy as the keys jangle against one another. The movement of the keys on the keyring can also make it challenging for a user to find a desired key on the ring, as there is typically no defined starting point for ordering the keys. A mechanism to organize keys is therefore needed.

SUMMARY

A key comprises a body with a head and a blade and one or more magnets in the body. The key can be part of a key set including a plurality of keys. Each key can have a hole through the head, for example through approximately the center of the head. The key set can include a hub through the holes in the keys, such that the keys are coupled by and are rotatable around the hub. The magnets in the keys can silence the keys and resist, index, and lock rotation of the keys around the hub. The magnets can also perform the same action on other accessories carried with keys, such as pocket clips, cutters, tools, lights, access fobs, writing instruments, locator beacons, radio frequency identification chips, straps, nail cleaners, toothpick holders, and money clips. The magnets can interact with magnets or magnetic material attached or embedded in a case, housing, or device designed to hold keys to silence the keys and resist, index, and lock rotation of the keys around a hub or axis.

DETAILED DESCRIPTION

Figure 1A:
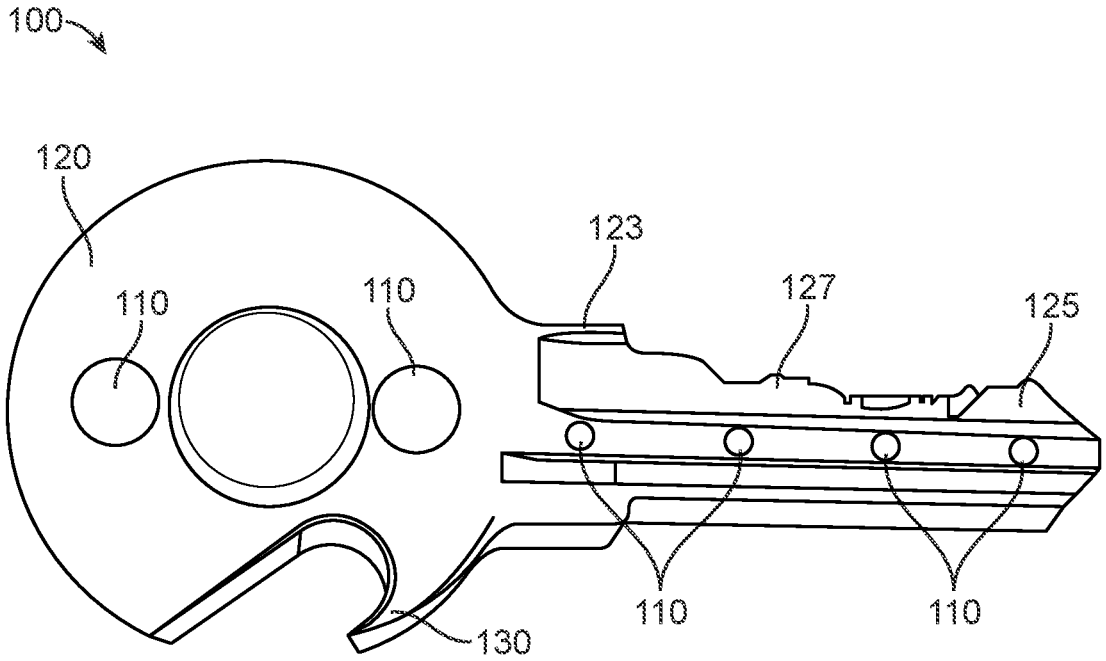
FIG. 1A illustrates a variation of a key including one or more magnets.

FIG. 1A illustrates a key 100 including one or more magnets 110. The key 100 can have a key head 120, key neck 123, and a key blade 125. The key blade 125 can have one or more bits 127 configured to engage a locking mechanism of a lock. One or more magnets 110 can be embedded within (e.g., press-fit into) or attached to the key head 120, can be embedded within (e.g., press-fit into) or attached to the key neck 123, can be embedded within (e.g., press-fit into) or attached to the key blade 125, or any combination thereof. For example, one or more magnets 110 can be embedded within (e.g., press-fit into) or attached to the key head 120. As another example, one or more magnets 110 can be embedded within (e.g., press-fit into) or attached to the key neck 123. As yet another example, one or more magnets 110 can be embedded within (e.g., press-fit into) or attached to the key blade 125. As still yet another example, one or more magnets 110 can be embedded within (e.g., press-fit into) or attached to the key head 120 and one or more magnets 110 can be embedded within (e.g., press-fit into) or attached to the key blade 125.

The key head, key neck, and key neck 120, 123, 125 can have the same or different number of magnets 110 as one another. For example, the key head 120 can have 0 to 30 or more magnets 110, including every 1 magnet 110 increment within this range (e.g., 0 magnets, 1 magnet, 2 magnets, 5 magnets, 30 magnets). The key neck 123 can have 0 to 10 or more magnets 110, including every 1 magnet 110 increment within this range (e.g., 0 magnets, 1 magnet, 2 magnets, 5 magnets, 10 magnets). The key blade 125 can have 0 to 20 or more magnets 110, including every 1 magnet 110 increment within this range (e.g., 0 magnets, 1 magnet, 2 magnets, 5 magnets, 20 magnets). For example, FIG. 1A illustrates that the key head 120 can have two magnets 110, that the key neck 123 can have one magnet 110, and that the key blade 125 can have three magnets 110.

The key 100 can be magnetically coupled to other keys 100 or metallic objects by the magnets 110. For example, the key 100 can be coupled to other keys 100 to form a key set. As another example, the key 100 can be magnetically coupled to a mailbox or car to store and hide the key 100.

FIG. 1A further illustrates that the key 100 can have a bottle opener notch 130. The notch 130 can be sized to fit under the cap of a bottle to remove the cap from the bottle when force is applied. The notch 130 can be on a side of the key head 120 opposite the bits 127, such that a user applies force to the flat side of the key blade 125 when opening a bottle rather than the bits 127.

Figure 1B:
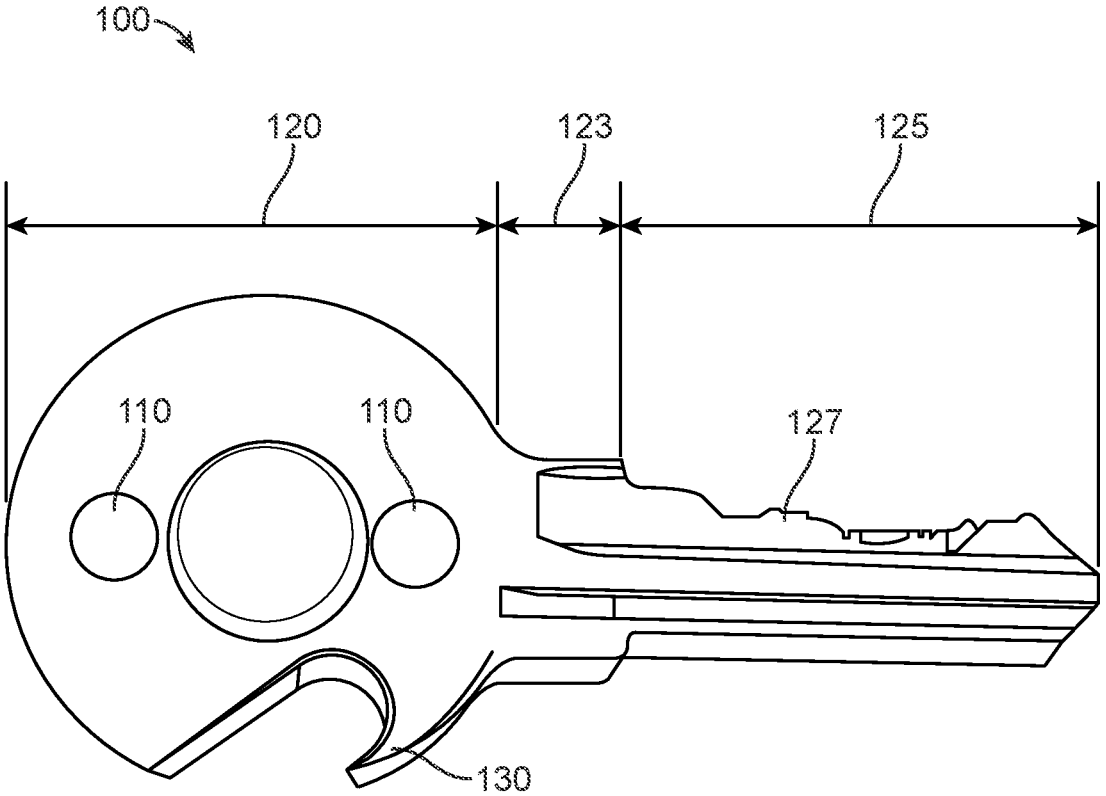
FIG. 1B illustrates a variation of a key including one or more magnets.

FIG. 1B illustrates that the key 100 can have one or multiple magnets 110 on or in the key head 120 with or without one or multiple magnets 110 on or in the key neck 123 and/or with or without one or multiple magnets 110 on or in the key blade 125.

Figure 1C:
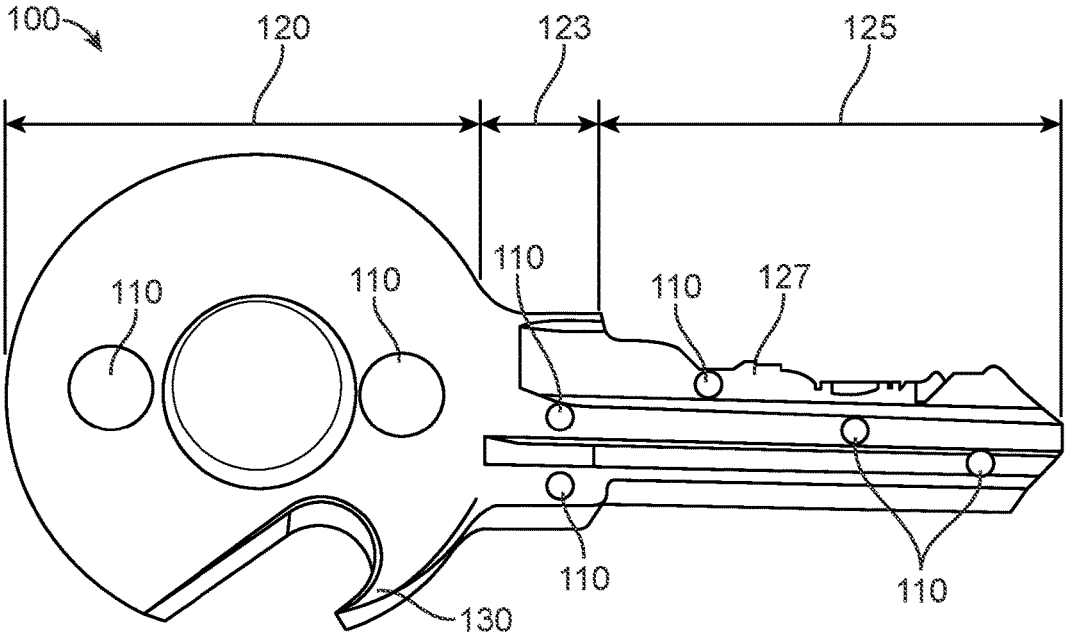
FIG. 1C illustrates a variation of a key including one or more magnets.

FIG. 1C illustrates that various portions of the key blade 125 can have one or multiple magnets 110.

Figure 1D:
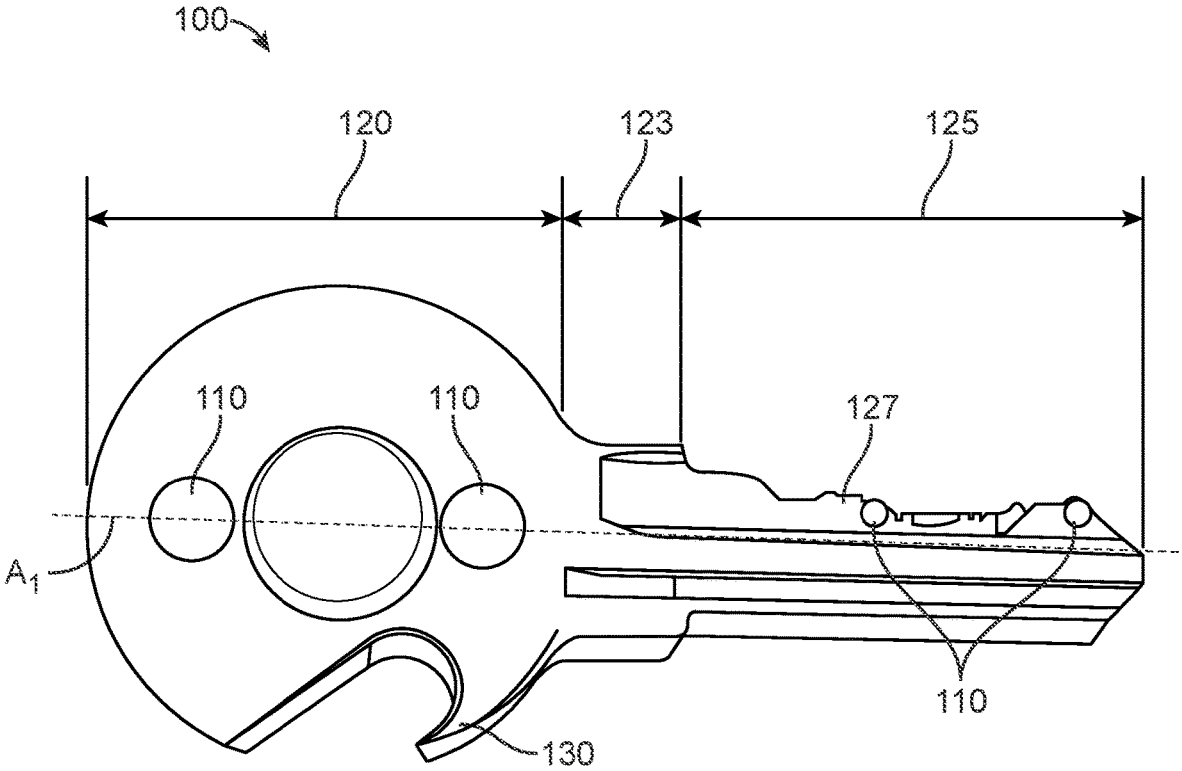
FIG. 1D illustrates a variation of a key including one or more magnets.

FIG. 1D illustrates that one or multiple bits 127 can be a magnet 110 or can include a magnet 110.

Figure 1E:
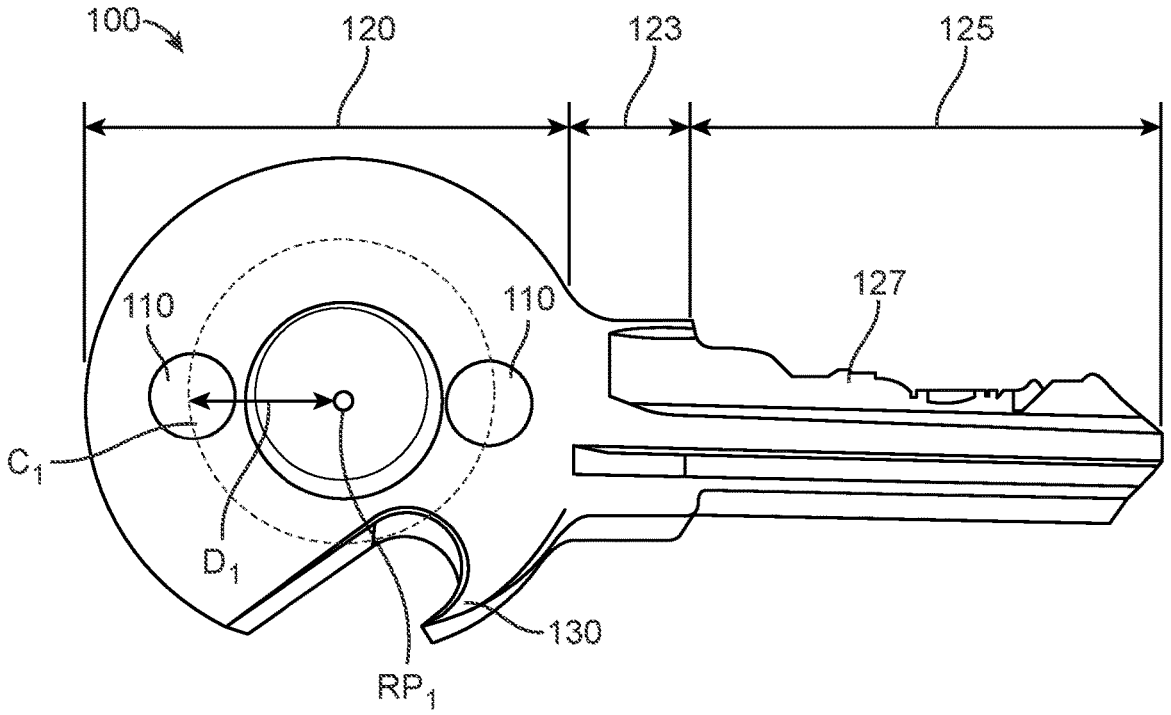
FIG. 1E illustrates a variation of a key including one or more magnets.

FIG. 1E illustrates that one or multiple magnets 110 on or in the key head 120 can be a distance $D_1$ between a key head reference point $RP_1$ and the magnet 110. The key head reference point $RP_1$ can be the center of the key head 120, and the distance $D_1$ can be measured from the key head reference point $RP_1$ to an edge or a center of the magnet 110. The distance $D_1$ can be about 2.0 mm to about 15.0 mm, including every 0.1 mm increment within this range (e.g., 2.0 mm, 5.0 mm, 7.5 mm). The distance $D_1$ can be a radius of a circle. For example, FIG. 1E further illustrates that one or multiple magnets 110 can be distributed on a first circle $C_1$ having a radius $D_1$. The farther out the magnet(s) 110 are on a radius from a center of the key head 120 (e.g., the key head reference point $RP_1$), the stronger the resistance to rotation (also referred to as the moment arm) can be to accommodate different resistance values for heavier or longer keys. As another example, the greater $D_1$, the greater the moment arm can be. As $D_1$ increases, the moment arm can increase. For example, the moment arm can increase by about 10% to 100% or more for every 0.5 mm to 1.0 mm increase in $D_1$ (e.g., increase in the radius). For example, for a first radius, the moment arm can be a first value and for a second radius the moment arm can be a second value, where the second value can be 10% to 100% or more greater than the first value.

Figure 1F:
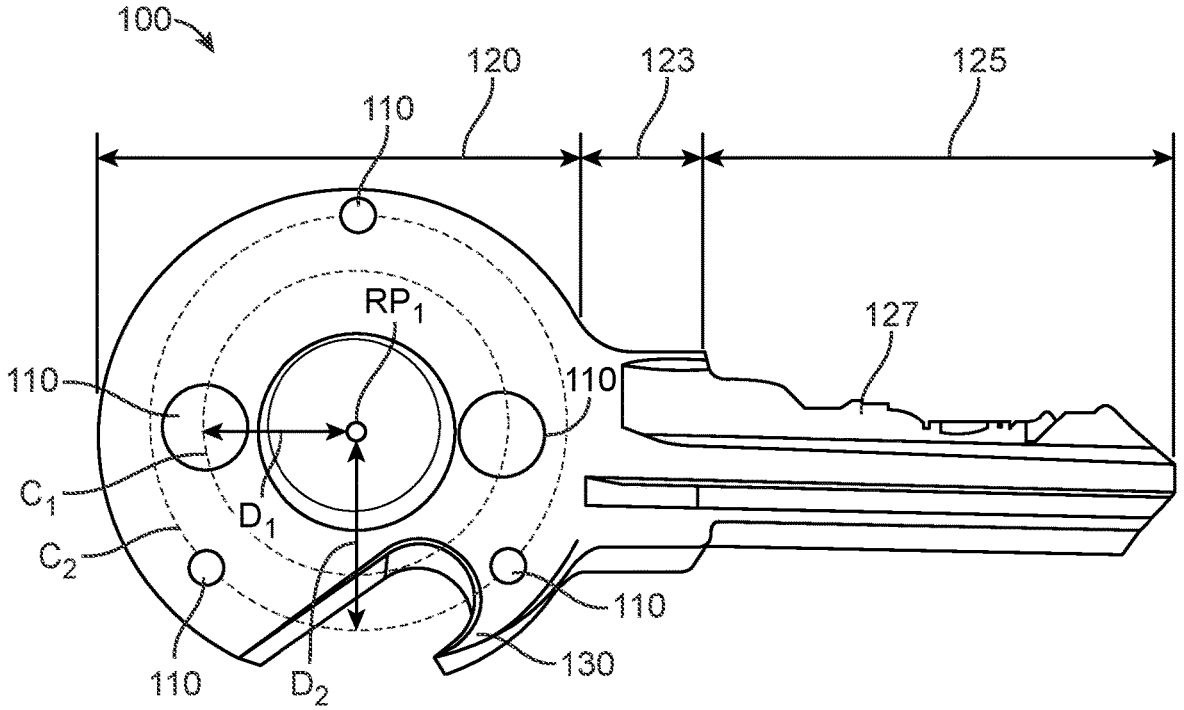
FIG. 1F illustrates a variation of a key including one or more magnets.

FIG. 1F illustrates that one or multiple magnets 110 on or in the key head 120 can be a distance $D_2$ between the key head reference point $RP_1$ and the magnet 110. The distance $D_2$ can be measured from the key head reference point $RP_1$ to an edge or a center of the magnet 110. The distance $D_2$ can be about 3.0 mm to about 20.0 mm, including every 0.1 mm increment within this range (e.g., 3.0 mm, 5.0 mm, 7.5 mm, 12.0 mm). The distance $D_2$ can be a radius of a circle. For example, FIG. 1F further illustrates that one or multiple magnets 110 can be distributed on a second circle $C_2$ having a radius $D_2$. The magnets 110 distributed on the first circle $C_1$ can be the same or a different size as the magnets 110 distributed on the second circle $C_2$. For example, the magnet(s) 110 distributed on the first circle $C_1$ can be larger than the magnet(s) 110 distributed on the second circle $C_2$, or vice versa.

FIGS. 1A-1F further illustrate that the one or multiple magnets 110 in the key head, key neck, and key neck 120, 123, 125 can be the same or different size as one another. For example, the magnets 110 in the key head 120 can be larger than the magnets 110 in the key neck and/or key blade 123, 125, or vice versa.

One or multiple magnets 110 can contact another magnet 110 and/or one or multiple magnets 110 can be separated by a separation distance from one or multiple other magnets 110. For example, the separation distance between two magnets 110 (e.g., a first magnet 110 and a second magnet 110) can be about 0.00 mm to about 50.00 mm, including every 0.25 mm increment within this range (e.g., 0.00 mm, 0.25 mm, 2.00 mm, 5.00 mm, 7.50 mm, 50.00 mm). The separation distance can be measured between any two magnets 110, for example, between adjacent magnets 110. Adjacent magnets 110 can be any two magnets 110, for example, that do not have one or multiple other magnets (e.g., magnets 110) between them. As another example, adjacent magnets 110 can be any two magnets 110, for example, that have zero, one, or multiple other magnets (e.g., magnets 110) between them. The separation distance can be measured between any two points on or in the magnets 110, including, for example, between magnet centers, between magnet edges, and/or any portion of the magnets between the magnet centers and the magnet edges. Where one or multiple magnets 110 have a hole (e.g., a hole through the center of the magnet(s) 110), the center of the magnet(s) 110 can be the center of the hole through the magnet(s) 110. The separation distance can be measured along a straight or a curved line. The separation distance can be the linear spacing between two or more magnets 110. For example, the separation distance can be measured along a longitudinal axis $A_1$ of the key 100 (e.g., see FIG. 1D). FIG. 1D further illustrates that the key longitudinal axis $A_1$ can pass through a center of the key head 120 (e.g., reference point $RP_1$). As another example, the key longitudinal axis $A_1$ can be offset from the reference point $RP_1$ such that the key longitudinal axis $A_1$ does not pass through the reference point $RP_1$. The longitudinal axis $A_1$ can be straight or curved. The longitudinal axis A1 can pass through or along the key head 120, the key neck 123, the key blade 125, or any combination thereof (e.g., FIG. 1D illustrates that the longitudinal axis $A_1$ can pass through the key head 120, the key neck 123, and the key blade 125). The separation distance can be measured between magnet(s) 110 in a single key 100. As another example, the separation distance can be measured between magnets 110 in multiple keys 100, for example, between any two magnets in a key set 200. For example, the separation distance can be measured between a first magnet 110 in a first key 100 and a second magnet 110 in a second key 100.

The magnet(s) can have a magnet length, a magnet width, and a magnet height. The magnet height can be the same as the thickness of the key 100, less than the thickness of the key 100, or greater than the thickness of the key 100. The magnet(s) 110 can have a magnet length of about 1.00 mm to about 10.00 mm, including every 0.25 mm increment within this range. The magnet(s) 110 can have a magnet width of about 1.00 mm to about 10.00 mm, including every 0.25 mm increment within this range. The magnet(s) 110 can have a magnet height of about 1.00 mm to about 10.00 mm, including every 0.25 mm increment within this range. The magnet length and the magnet width can be the same as or different from one another. For example, where the magnet length and the magnet width are the same as one another, the magnet length and the magnet width can be the diameter of magnet(s) 110 or can be the radius of the magnet(s) 110. For example, the magnets can have a 5.0 mm diameter and can have a thickness (also referred to as the magnet height) of about 2.0 mm to correspond properly with the key thickness. The magnet(s) 110 can have a cylindrical shape, can have a tapered shape, or both. For example, one or multiple magnets 110 can have a cylindrical shape, one or multiple magnets 110 can have a cone shape, one or multiple magnets 110 can have a frusto-conical shape, or any combination thereof. As yet another example, the magnet length can be the same as the length of the key blade 125, less than the length of the key blade 125, or greater than the length of the key blade 125. As still yet another example, the magnet length can be the same as the length of the key neck 123, less than the length of the key neck 123, or greater than the length of the key neck 123. As still yet another example, the magnet length can be the same as the length of the key head 120, less than the length of the key head 120, or greater than the length of the key head 120.

Figure 2:
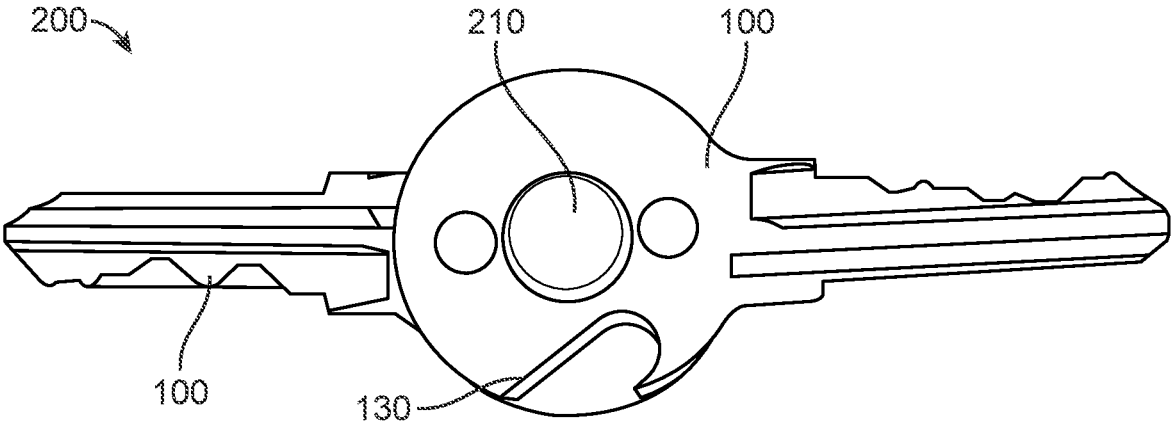
FIG. 2 illustrates multiple keys forming a key set.

FIG. 2 illustrates multiple keys 100 forming a key set 200. The key set 200 can include a hub 210 passing through a hole in each of the keys 100. The keys 100 in the set 200 can be rotatable around the hub 210. The key set 200 can have keys 100 with one or multiple magnet variations. For example, each key 100 in the key set 200 can have the magnet variation shown in FIG. 1A, FIG. 1B, FIG. 1C, FIG. 1D, FIG. 1E, FIG. 1F, or any combination of the magnets, for example, shown in FIGS. 1A-1F. As another example, the key set 200 can have two or more key subsets (also referred to as key subgroups). For example, the key set 200 can have 2 to 10 or more key subgroups (e.g., first through tenth key subgroups 200*a*-200*j*), including every 1 key subgroup within this range. Each key 100 in a key subset can have the same magnet configuration as the other keys 100 in the key subset. Keys 100 of different subsets can have the same or a different magnet configuration as other keys 100 in another key subset. For example, a first key subset can have a first magnet variation (e.g., having one or multiple magnets 110) and a second key subset can have a second magnet variation (e.g., having one or multiple magnets 110) the same as or different from the first magnet variation. For example, each key 100 in the first key subset can have the magnet variation shown in FIG. 1A, FIG. 1B, FIG. 1C, FIG. 1D, FIG. 1E, FIG. 1F, or any combination of the magnets, for example, shown in FIGS. 1A-1F. Each key 100 in the second key subset can have the magnet variation shown in FIG. 1A, FIG. 1B, FIG. 1C, FIG. 1D, FIG. 1E, FIG. 1F, or any combination of the magnets, for example, shown in FIGS. 1A-1F.

The magnets 110 can releasably couple the keys in the set 200, improving orderliness of the key set 200 and reducing noise by preventing the keys from jangling against one another. The magnets 110 can resist, index, and lock rotation of the keys 100 around a fixed axis. An orientation of a key 100 relative to the key set 200 in which the key's magnet 110 interacts with a magnet 110 on another key is referred to herein as a "locking position" of the key. Under nominal forces, including the weight of the key 100, the magnetic forces can maintain the key 100 in the locking position. An intentional force applied by a user can overcome the magnetic forces, for example to rotate the key 100 around the hub 210 and away from other keys in the set 200. The magnets 110 can have a pull force that is high enough to reduce the likelihood of unintentional decoupling of the keys, while low enough to allow a user to rotate a key in the set 200 with a single hand. For example, the magnets 110 can be neodymium boron magnets with a grade between N40 and N52. Magnets 110 on or in the key head 120, key neck 123, and/or key blade 125 can desirably resist, index, and lock rotation of multiple keys 100 in a locked position. For example, magnets 110 on or in the key neck 123 and/or key blade 125 can desirably resist, index, and lock rotation of multiple keys 100 in a locked position.

The magnet(s) on or in the key head 120 (also referred to as the key head magnets) can be magnetically coupleable to corresponding magnet(s) on or in the key heads of other keys (e.g., the key heads 120 of other keys 100). The magnet(s) on or in the key neck 123 (also referred to as the key neck magnets) can be magnetically coupleable to corresponding magnet(s) on or in the key necks of other keys (e.g., the key necks 123 of other keys 100). The magnet(s) on or in the key blade 125 (also referred to as the key blade magnets) can be magnetically coupleable to corresponding magnet(s) on or in the key blades of other keys (e.g., the key blades 125 of other keys 100).

The key head magnets can provide two or more angular locking positions for a key 100 relative to other keys 100 in a set 200. The key neck and/or key blade magnets can provide a home locking position for a key 100 relative to other keys 100 in a set 200, where the home locking position can be the position between two keys (e.g., a first key 100 and a second key 100) when the key head 120 and the key blade 125 of two or more keys 100 are aligned and magnetically coupled with one another. The key neck and/or key blade magnets can lock the keys 100 in the home locking position such that the key head magnets can be responsible for locking one or multiple keys 100 in one or multiple angular positions different from the home locking position. For example, FIGS. 1A-1F can further illustrate multiple keys 100 aligned in a home locking position (e.g., 2 to 10 or more keys 100), stacked against each other in the same angular position. With or without one or multiple key neck magnets 110 and/or key blade magnets 110, the key 100 can have 1-20 key head magnets 110, including every 1 magnet 110 increment within this range. The key head magnets 110 can be used to achieve the desired locking positions away from the home locking position. For example, FIG. 2 illustrates that for keys 100 having a first magnet 110 and a second magnet 110, the home locking position can be at 0 degrees (e.g., aligned with the other keys in the set 200) and each key 100 can have a locking position an angular displacement at about 30 degrees to about 330 degrees from the home locking position (e.g., at 180 degrees as shown in FIG. 2).

One or multiple magnets 110 on or in the key neck and/or key blade 123, 125 can magnetically couple different groups of keys 100 together in a single set 200. For example, where the set 200 has six keys 100 with two subgroups of three keys (e.g., three personal keys and three work keys), the key neck magnets 110 and/or the key blade magnets 110 can couple the three personal keys together and can separately couple the three work keys together such that the two 3-key subgroups can be put on a key ring or can be put on a hub 210 together with or without magnetic coupling between the two 3-key subgroups. With magnetic coupling between the two 3-key subgroups, the key subgroups can be indexed (e.g., rotated) into different locking positions as a subgroup, and the keys within each subgroup can be further indexed (e.g., rotated) into different positions, for example, via the one or multiple magnets 110 in the key head 120. Without magnetic coupling between the two 3-key subgroups, the subgroups can rotate freely relative to one another about the hub 210. A key subgroup can have, for example, 1 to 20 keys 100, including every 1 key 100 increment within this range (e.g., 1 key, 2 keys, 3 keys, 5 keys, 10 keys). A first key subgroup can have the same or a different number of keys as a second key subgroup. For example, first and second key subgroups can have three keys 100 each. As another example, a first key subgroup can have 2 keys 100 and a second key subgroup can have 5 keys 100.

As yet another example, one or multiple magnets 110 on or in the key neck and/or key blade 123, 125 can magnetically repel one or multiple keys 100 away from one or multiple other keys 100 in the key set 200 or in a key subgroup, where each key subgroup can have one or multiple keys 100. Repelling one or multiple keys 100 (e.g., 1-10 or more keys 100) in this way can be desirable, for example, where one or multiple keys 100 in a key set (e.g., set 200) and/or in a key subgroup are to be kept separate from another key 100 or keys 100 in the key set (e.g., 200) or subgroup, yet still be in close proximity to one another.

As still yet another example, one or multiple keys 100 in a key set (e.g., set 200) or a key subgroup may neither magnetically attract nor magnetically repel one or multiple other keys 100 in the key set 200 or the key subgroup. This can be desirable, for example, where one or multiple keys 100 in a set 200 and/or in a key subgroup are to be kept separate from another key 100 or keys 100 in the set 200 or subgroup, yet still be in close proximity to one another. The lack of magnetic interaction (e.g., attraction or repulsion) can be because one or multiple keys 100 may not have a magnet 110 and/or because the magnet(s) 110 of a first key are too far from the magnet(s) 110 of a second key to magnetically attract or repel one another.

One or multiple keys 100 in a key set (e.g., set 200) or a key subgroup can magnetically attract one or multiple other keys 100 in the set or subgroup, can magnetically repel one or multiple other keys 100 in the set or subgroup, may neither magnetically attract nor magnetically repel one or multiple other keys 100 in the key set 200 or the key subgroup, or any combination thereof. For example, a key 100 (also referred to as a reference key) can magnetically attract 1 to 4 keys, including every 1 key increment within this range, away from the reference key 100 in either direction such that a single key 100 can magnetically interact with one or multiple magnets 110 of 1 to 8 other keys 100 (e.g., 1 or 2 keys 100, such as the one or two keys 100 immediately adjacent to the reference key 100). As another example, each key 100, including the reference key 100, can magnetically couple to a single adjacent key 100. For example, the end keys 100 in a key set 200 having two or more keys 100 can magnetically couple to a single adjacent key (e.g., as shown in FIGS. 1A-2). Keys 100 beyond the reach of the magnetic field of the magnets 110 of the reference key 100 may neither be magnetically attracted to nor magnetically repelled by the reference key 100. As another example, the reference key 100 (e.g., one of the keys in FIGS. 1A-2) can magnetically repel 1 to 4 keys, including every 1 key increment within this range, away from the reference key 100 in either direction such that a single key 100 can magnetically interact with one or multiple magnets 110 of 1 to 8 other keys 100 (e.g., 1 or 2 keys 100, such as the one or two keys 100 immediately adjacent to the reference key 100).

FIGS. 1A-2 further illustrate that a key 100 (e.g., each key 100) can be rotated clockwise and/or counterclockwise away from the home locking position. Each key 100 can be rotated individually relative to the other keys 100 in the key set 200. As another example, two or more keys 100 can be rotated together (e.g., in unison) relative to one or multiple other keys 100 in the key set 200.

Figure 3:
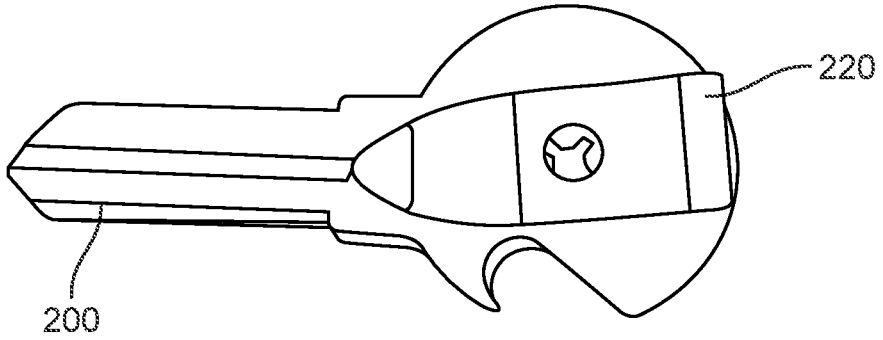
FIG. 3 shows a rear view of an example key set.
Figure 4:
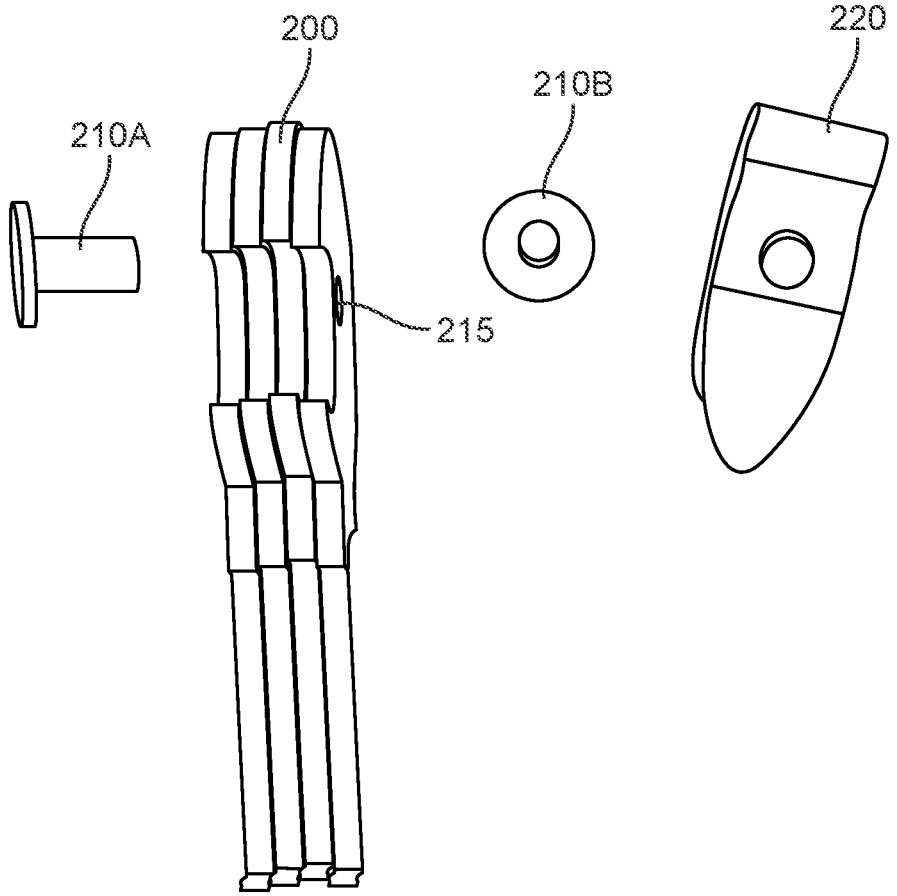
FIG. 4 shows an example key set disassembled.

FIG. 3 shows a rear view of the example key set 200, and FIG. 4 shows the example key set 200 disassembled. As shown in FIGS. 3 and 4, the set 200 can include a clip 220, for example to clip the key set to a pants or shirt pocket. The clip 220 can be attached to the key set 200 by the hub 210.

FIG. 4 shows the hub 210 can include two separable parts 210A and 210B. In the example of FIG. 4, a screw 210B can screw fit into a post 210A to form the hub 210. The post 210A and/or the screw 210B can fit through a hole 215 in the keys 200. The post 210A and/or the screw 210B can additionally fit through a hole in the clip 220 to attach the clip 220 to the keys 200. Other hub 210 configurations can be used instead of the post 210A and screw 210B. For example, multiple pieces—or opposite ends of a single piece—of the hub 210 may couple by screws, snaps, magnets, Velcro, or the like. The hub 210 can be configured to detach and reattach to allow a user to add keys to the set 200, remove keys from the set 200, or reorder the keys in the set 200.

The keys 100 in the key set 200 can each have two or more magnets 110 that are magnetically coupleable to corresponding magnets on the other keys. The two or more magnets 110 can provide two or more angular locking positions for a key 100 relative to other keys in the set 200. For example, if each key 100 has two magnets, each key can have a locking position at 0° (i.e., aligned with the other keys in the set 200) and at 180°.

Figure 5A:
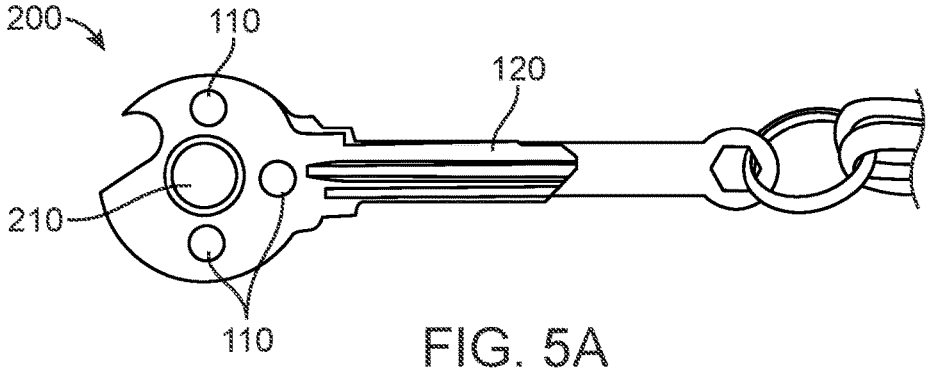
FIGS. 5A-5D illustrate an example key with three magnets distributed on a circle concentric to a hub.
Figure 5B:
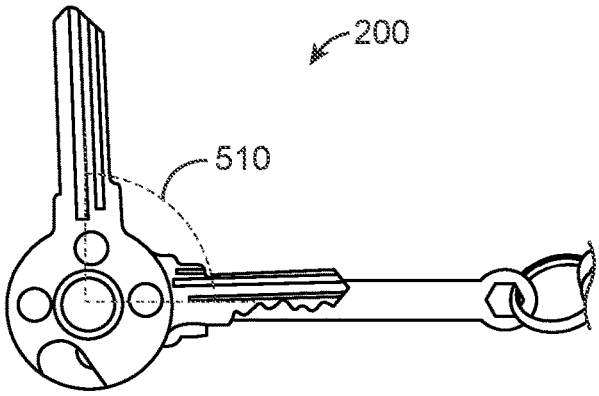
Figure 5C:
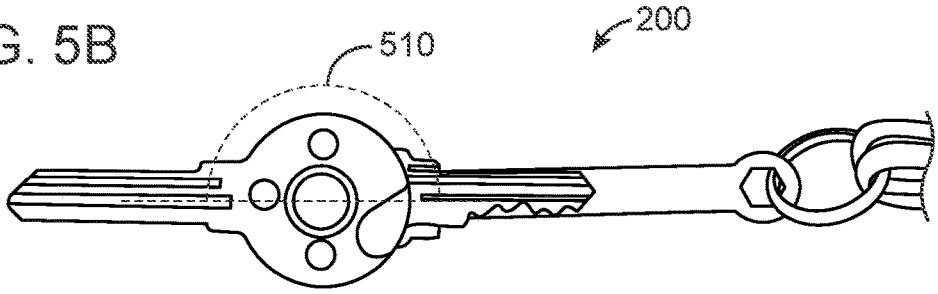
Figure 5D:
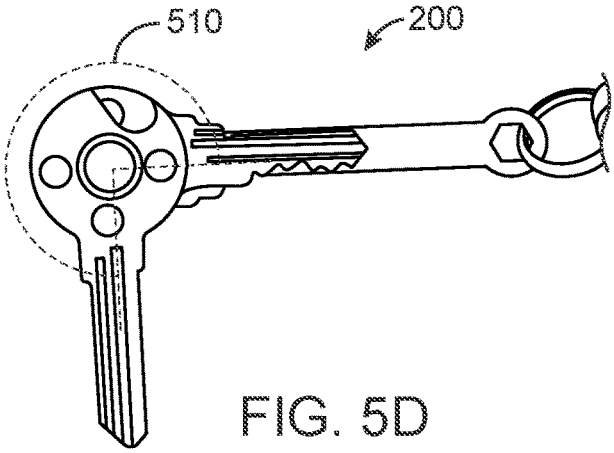

The magnets 110 can be distributed angularly around the hub 210. FIGS. 5A-5D illustrate an example key 100 with three magnets 110 distributed on a circle concentric to the hub 210. The circle can have a radius of about 2.0 mm to about 15.0 mm, including every 0.1 mm increment within this range (e.g., 2.0 mm, 5.0 mm, 7.5 mm). As shown in FIGS. 5A-5D, the three magnets 110 can give the key 100 locking positions at rotational angles 510 of approximately 0° (FIG. 5A), approximately 90° (FIG. 5B), approximately 180° (FIG. 5C), and approximately 270° (FIG. 5D). The locking positions of a key 100 out of alignment with other keys in the set 200 allow a user to use the key 100 without interference from the other keys in the set 200. Some locking positions may also provide a lever arm that reduces the amount of force a user must apply in order to lock or unlock a lock. For example, in FIGS. 5B and 5D, keys in the 0° provide a lever arm that can help a user lock or unlock a lock with the key 100 that is rotated to 90° or 270°.

The magnets 110 can be distributed around the hub 120 in manners other than that shown in FIGS. 5A-5D. For example, a key 100 can have three magnets distributed around the hub 210 such that the key 100 has locking positions at rotational angles of about 0°, 120°, and 240° relative to the other keys in the key set 200.

Figure 6:
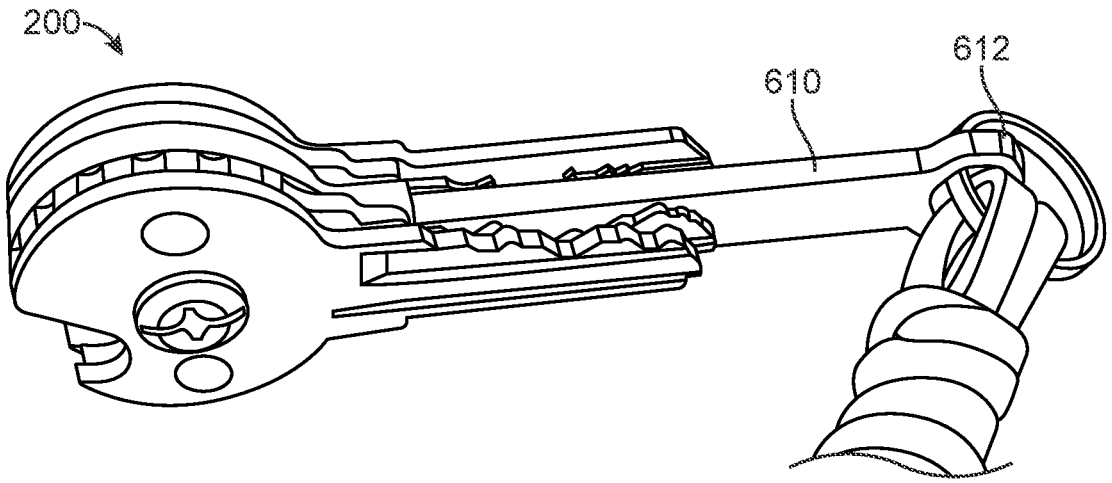
FIG. 6 illustrates an example key set including a bar.

FIG. 6 illustrates that the key set 200 can include a bar 610. The bar 610 can have a width, thickness, and/or shape approximately equivalent to those of a key 100. An end of the bar 610 can have a ring 612 to connect to a standard keyring. Other objects besides the keys 100 can be attached to the key set 200 by the keyring. For example, a user can attach keys that do not have the magnets 110 (such as an electronic fob for a vehicle) to the keyring. The bar 610 can comprise any of a variety of materials, including a metal such as aluminum or titanium, or a plastic such as nylon or acrylic.

Figure 7:
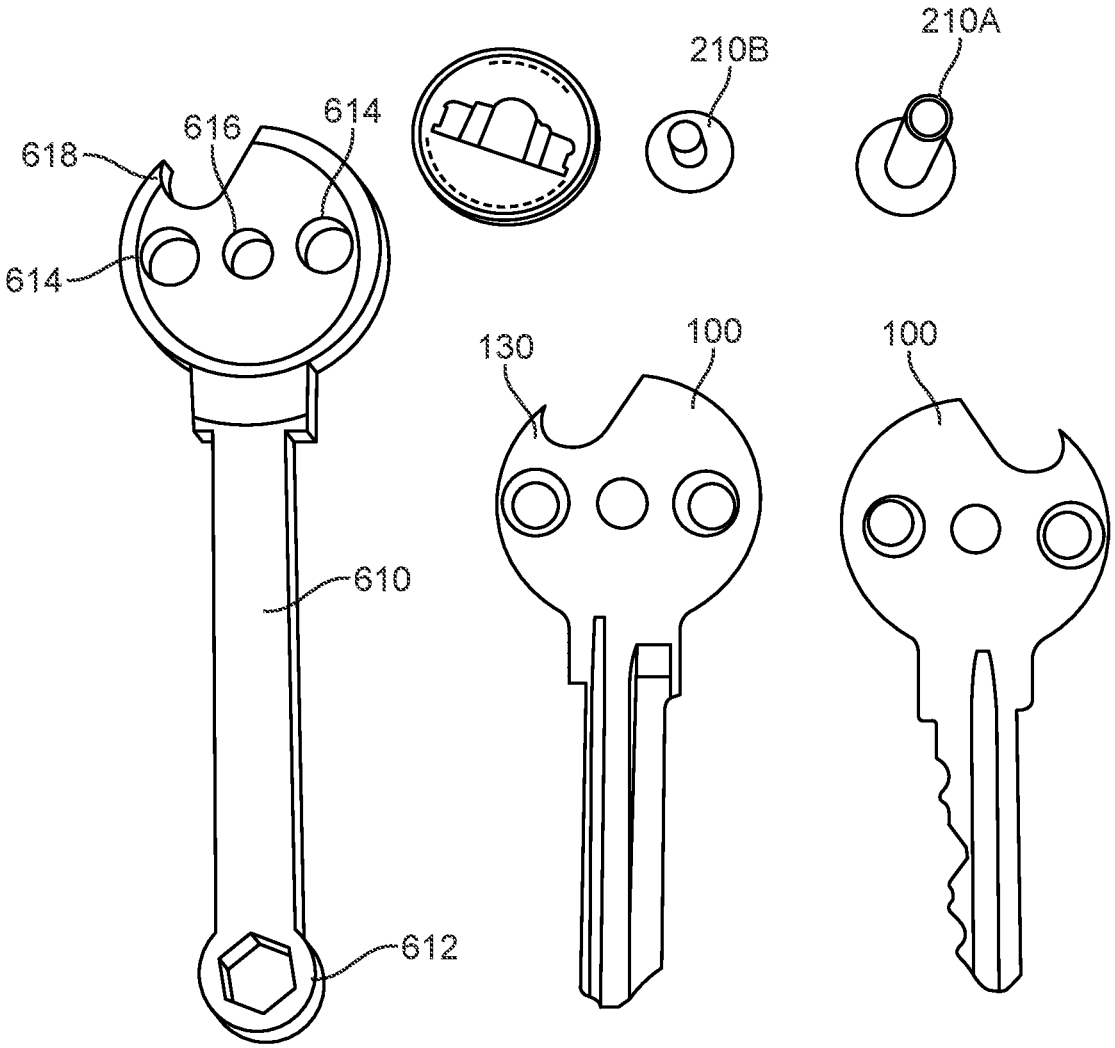
FIG. 7 illustrates a disassembled example of the key set with the bar.

FIG. 7 illustrates a disassembled example of the key set 200 with the bar 610. As shown in FIG. 7, the bar 610 can have one or more magnets 614. The magnets 614 may align with magnets 110 on the keys 100 when the keys are positioned at a specified orientation relative to the bar 610. The bar 610 can have a hole 616 through a portion of the bar 610 (e.g., through a center of a head), such that the hub 210 fits through the bar 610 to attach the keys 100 to the bar 610. The bar 610 can have a bottle opener notch 618 that aligns with the bottle opener notch 130 on the key 100 when the key 100 is coupled to the bar 610.

FIGS. 8A-8D illustrate that the key set 200 can include a case 800 enclosing the keys 100. The case 800 can include a first side 810A and a second side 810B placed on opposite sides of one or more keys 100 to encase a top and bottom side of the keys 100. The case 800 can be attached to the keys by the hub 210. For example, the hub can fit through a hole 816 in the case sides 810. Keys 100 can be coupled to one or both ends of the case 816 by the hub 210. The first side 810A can be rotated about hub 210 in direction 802 (e.g., clockwise) and/or direction 804 (e.g., counterclockwise), for example, relative to the keys 100 and/or the second side 810B. The second side 810B can be rotated about hub 210 in direction 802 (e.g., clockwise) and/or direction 804 (e.g., counterclockwise), for example, relative to the keys 100 and/or the first side 810A.

Figure 8A:
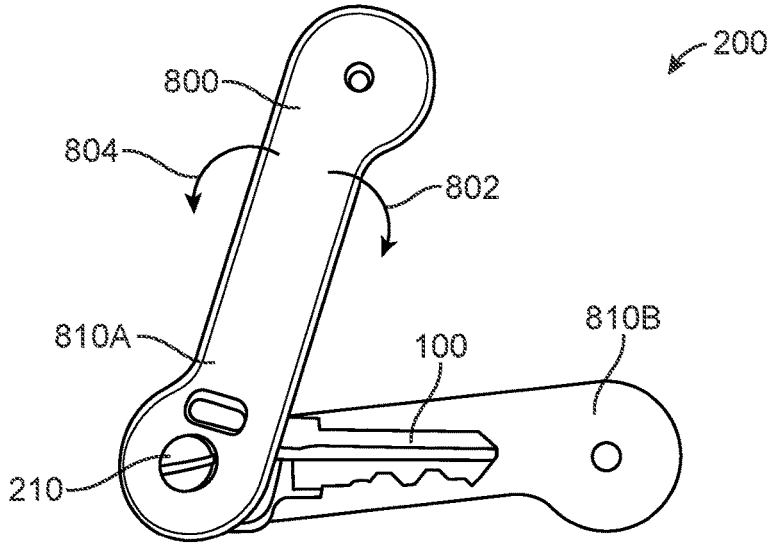
FIGS. 8A-8D illustrate an example case enclosing the key set.
Figure 8B:
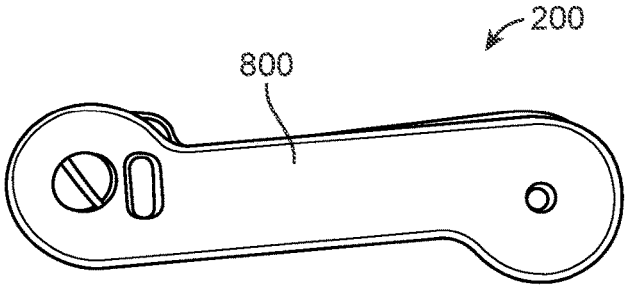
Figure 8C:
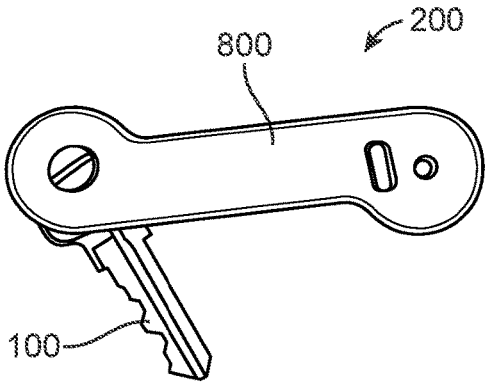

As shown in FIGS. 8B and 8C, the keys 100 can be rotatable around the hub 210 with respect to the case 800. FIG. 8B illustrates that a key 100 can be aligned in the case 800 such that the blade 125 does not extend beyond the sides 810. FIG. 8C illustrates that the key 100 can be rotated out of the case 800, such that the key 100 can be used to lock or unlock a lock.

Figure 8D:
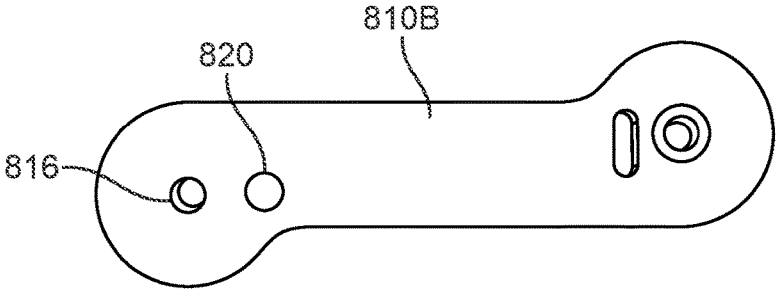

FIG. 8D shows one side 810B of the case 800, illustrating that the case 800 can include one or more magnets 820. The magnet 820 can be positioned to align with a magnet 110 on the key 100 at a specified position of the key. For example, the magnet 820 may be positioned such that the key 100 has a locking position in alignment with the case 800 (as shown in FIG. 8B). When force is applied to the key 100, the key 100 can be rotated away from its locking position. By positioning the magnet 820 to lock the key 100 in alignment with the case 800 and increase the force necessary to rotate the key 100, the case 800 can improve orderliness of the key set 200.

Figure 9A:
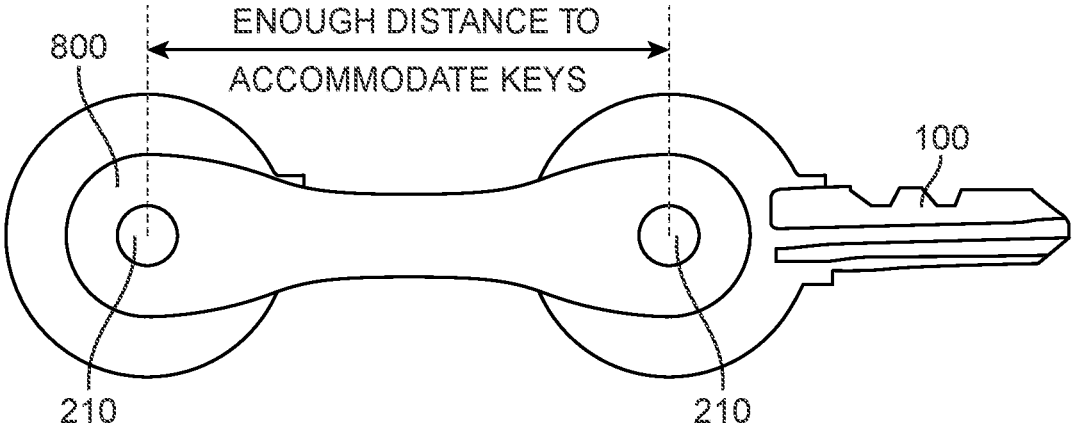
FIGS. 9A-9B illustrate another example case.
Figure 9B:
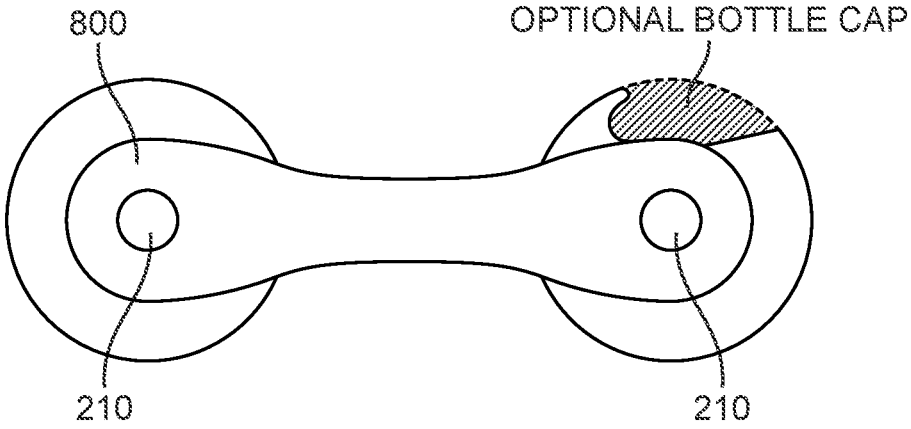

FIGS. 9A-9B illustrate another example case 800. A top view of the case 800 is shown in FIG. 9A, and a bottom view is shown in FIG. 9B. One or more keys 100 can be attached to the case 800 by a hub 210. Similar to the case 800 shown in FIG. 8, keys 100 can be coupled to one or both ends of the case 800. The keys 100 can rotate around the hub(s) 210, for example to rotate from an "open" position shown in FIG. 9A to a "closed" position shown in FIG. 9B.

Figure 10A:
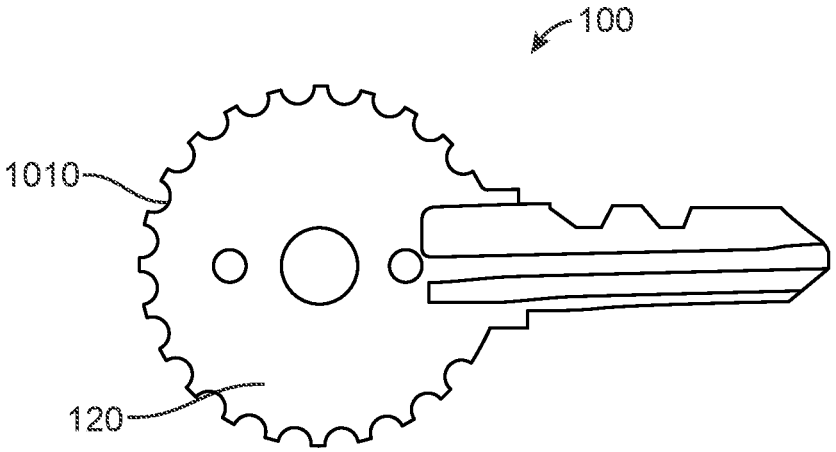
FIGS. 10A-10B illustrate example textured edges of keys.
Figure 10B:
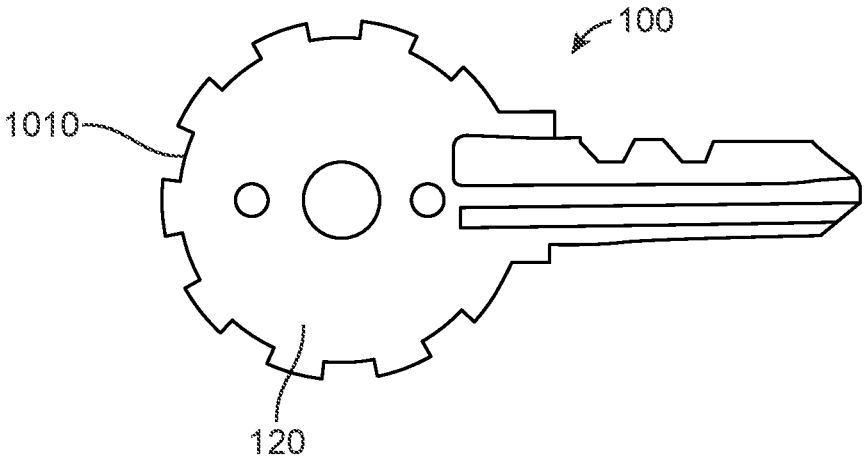

FIGS. 10A-10B illustrates that a key 100 can have a textured edge 1010, comprising patterned cuts or notches around the key head 120. Different textures can assist a user in identifying keys by touch. For example, a key set 200 can include keys with various different patterns around the textured edge 1010 such that each key 100 in the set 200 can be uniquely identified by touch. Two example textured edges 1010 are shown in FIGS. 10A and 10B, but a key 100 can have any of a variety of textures formed by cutting notches of any shape or size into the key head 120.

Each of the individual variations or embodiments described and illustrated herein has discrete components and features which may be readily separated from or combined with the features of any of the other variations or embodiments. Modifications may be made to adapt a particular situation, material, composition of matter, process, process act(s) or step(s) to the objective(s), spirit or scope of the disclosure.

Methods recited herein may be carried out in any order of the recited events that is logically possible, as well as the recited order of events. Moreover, additional steps or operations may be provided or steps or operations may be eliminated to achieve the desired result.

Furthermore, where a range of values is provided, every intervening value between the upper and lower limit of that range and any other stated or intervening value in that stated range is encompassed within the disclosure. Also, any optional feature of the variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present disclosure (in which case what is present herein shall prevail). The referenced items are provided solely for their disclosure prior to the filing date of the present application. Nothing herein is to be construed as an admission that the present disclosure is not entitled to antedate such material by virtue of prior disclosure.

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of elements, or use of a "negative" limitation. Unless defined otherwise, all technical and scientific terms used herein have the same meaning as commonly understood by one of ordinary skill in the art to which this invention belongs.

This disclosure is not intended to be limited to the scope of the particular forms set forth, but is intended to cover alternatives, modifications, and equivalents of the variations described herein. Further, the scope of the disclosure fully encompasses other variations that may become obvious to those skilled in the art in view of this disclosure.

We claim:

1. A key set comprising:

a key comprising a body having a head and a blade, a key hole through the head, a key first magnet in the head, and a key second magnet in the head, wherein the key first magnet is closer to the blade than the key second magnet;

an accessory comprising a hole, an accessory first magnet, and an accessory second magnet; and a hub through the key hole and the hole, wherein the key is rotatable around the hub relative to the accessory such that the key first magnet and the key second magnet are rotatable around the hub relative to the accessory, wherein the key set has a first configuration and a second configuration, wherein when the key set is in the first configuration, the key first magnet is magnetically coupled to the accessory first magnet and the key second magnet is magnetically coupled to the accessory second magnet such that the key is indexed and locked in a first orientation relative to the accessory, wherein when the key set is in the second configuration, the key first magnet is magnetically coupled to the accessory second magnet and the key second magnet is magnetically coupled to the accessory first magnet such that the first key is indexed and locked in a second orientation relative to the accessory, and wherein the blade is closer to the accessory when the key set is in the first configuration than when the key set is in the second configuration.

2. The key set of claim 1, further comprising a key third magnet, wherein the key first magnet, the key second magnet, and the key third magnet are positioned at approximately equal angles around the key hole.

3. The key set of claim 1, wherein the key hole extends through approximately a center of the head, and wherein the head comprises a bottle opener notch.

4. A key set comprising:

a first key comprising a body having a first key head and a first key blade, a first key hole through the first key head, a first key first magnet in the first key head, and a first key second magnet in the first key head, wherein the first key first magnet is closer to the first key blade than the first key second magnet;

a second key comprising a body having a second key head and a second key blade, a second key hole through the second key head, a second key first magnet in the second key head, and a second key second magnet in the second key head, wherein the second key first magnet is closer to the second key blade than the second key second magnet; and a hub through the first key hole and the second key hole, wherein the first key and the second key are rotatable around the hub such that the first key first magnet and the first key second magnet are rotatable around the hub and such that the second key first magnet and the second key second magnet are rotatable around the hub, wherein the first key first magnet is rotatable into and out of alignment with the second key first magnet, wherein the first key first magnet is rotatable into and out of alignment with the second key second magnet, wherein the first key second magnet is rotatable into and out of alignment with the second key first magnet, wherein the first key second magnet is rotatable into and out of alignment with the second key second magnet, wherein the second key first magnet is rotatable into and out of alignment with the first key first magnet, wherein the second key first magnet is rotatable into and out of alignment with the first key second magnet, wherein the second key second magnet is rotatable into and out of alignment with the first key first magnet, wherein the second key second magnet is rotatable into and out of alignment with the first key second magnet, wherein the key set has a first configuration, a second configuration, and a third configuration, wherein when the key set is in the first configuration, the first key first magnet is aligned with and magnetically coupled to the second key first magnet and the first key second magnet is aligned with and magnetically coupled to the second key second magnet such that the first key is indexed and locked in a first orientation relative to the second key, wherein when the key set is in the second configuration, the first key has a second orientation relative to the second key and the first key first magnet and the first key second magnet are between the second key first magnet and the second key second magnet, and wherein when the key set is in the third configuration, the first key first magnet is aligned with and magnetically coupled to the second key second magnet and the first key second magnet is aligned with and magnetically coupled to the second key first magnet such that the first key is indexed and locked in a third orientation relative to the second key.

5. The key set of claim 4, wherein the hub comprises a first piece and a second piece, wherein the first piece is releasably coupleable to the second piece, and wherein at least a portion of the first piece and at least a portion of the second piece are sized to fit through the first key hole.

6. The key set of claim 4, further comprising a bar coupleable to the hub, wherein the bar comprises one or more magnets and means of attaching a keyring.

7. The key set of claim 6, wherein the first key further comprises a first key bottle opener notch, wherein the second key further comprises a second key bottle opener notch, and wherein the bar comprises a bottle opener notch movable into and out of alignment with the first key bottle opener notch and the second key bottle opener notch.

8. The key set of claim 4, further comprising a pocket clip or other accessories coupled to the hub.

9. The key set of claim 4, further comprising a case partially enclosing the first key and the second key.

10. The key set of claim 9, wherein the case comprises one or more magnets coupleable to the first key first magnet, the first key second magnet, the second key first magnet, or the second key second magnet.

11. The key set of claim 4, wherein at least one of the first key and the second key comprises a textured edge.

12. The key set of claim 4, wherein the first key hole extends through approximately a center of the first key head, wherein the second key hole extends through approximately a center of the second key head, wherein the first key further comprises a first key third magnet, wherein the first key first magnet, the first key second magnet, and the first key third magnet are positioned at approximately equal angles around the first key hole, wherein the second key further comprises a second key third magnet, and wherein the second key first magnet, the second key second magnet, and the second key third magnet are positioned at approximately equal angles around the second key hole.

13. The key set of claim 4, wherein when the key set is in the first configuration, the first key first magnet is magnetically coupled to the second key first magnet such that a magnetic attraction between the first key first magnet and the second key first magnet resists rotation of the first key relative to the second key around the hub, and wherein when the key set is in the first configuration, the first key second magnet is magnetically coupled to the second key second magnet such that a magnetic attraction between the first key second magnet and the second key second magnet resists rotation of the first key relative to the second key around the hub.

14. The key set of claim 4, wherein the first key hole extends through approximately a center of the first key head, wherein the second key hole extends through approximately a center of the second key head, wherein the first key hole is between the first key first magnet and the first key second magnet, and wherein the second key hole is between the second key first magnet and the second key second magnet.

15. The key set of claim 14, wherein when the key set is in the first configuration, the first orientation of the first key relative to the second key comprises a rotation of the first key around the hub of approximately 0 degrees relative to the second key, wherein when the key set is in the second configuration, the second orientation of the first key relative to the second key comprises a rotation of the first key around the hub between the first orientation of the first key relative to the second key and the third orientation of the first key relative to the second key, and wherein when the key set is in the third configuration, the third orientation of the first key relative to the second key comprises a rotation of the first key around the hub of approximately 180 degrees relative to the second key.

16. The key set of claim 4, wherein when the key set is in the first configuration, the first orientation of the first key relative to the second key comprises a rotation of the first key around the hub of approximately 0° relative to the second key, wherein when the key set is in the second configuration, the second orientation of the first key relative to the second key comprises a rotation of the first key around the hub between the first orientation of the first key relative to the second key and the third orientation of the first key relative to the second key, and wherein when the key set is in the third configuration, the third orientation of the first key relative to the second key comprises a rotation of the first key around the hub of approximately 90° relative to the second key.

17. The key set of claim 1, wherein the key first magnet and the key second magnet are aligned along an axis that extends across the key hole.

18. The key set of claim 1, wherein the key first magnet and the key second magnet are the same distance from the key hole.

19. A key set comprising:

a first key comprising a body having a first key head and a first key blade, a first key hole through the first key head, a first key first magnet in the first key head, and a first key second magnet in the first key head, wherein the first key first magnet is closer to the first key blade than the first key second magnet;

a second key comprising a body having a second key head and a second key blade, a second key hole through the second key head, a second key first magnet in the second key head, and a second key second magnet in the second key head, wherein the second key first magnet is closer to the second key blade than the second key second magnet; and a hub through the first key hole and the second key hole, wherein the first key and the second key are rotatable around the hub such that the first key first magnet and the first key second magnet are rotatable around the hub and such that the second key first magnet and the second key second magnet are rotatable around the hub, wherein the first key first magnet is rotatable into magnetic attraction with the second key first magnet, wherein the first key first magnet is rotatable into magnetic attraction with the second key second magnet, wherein the first key second magnet is rotatable into magnetic attraction with the second key first magnet, wherein the first key second magnet is rotatable into magnetic attraction with the second key second magnet, wherein the second key first magnet is rotatable into magnetic attraction with the first key first magnet, wherein the second key first magnet is rotatable into magnetic attraction with the first key second magnet, wherein the second key second magnet is rotatable into magnetic attraction with the first key first magnet, wherein the second key second magnet is rotatable into magnetic attraction with the first key second magnet, wherein the key set has a first configuration, a second configuration, and a third configuration, wherein when the key set is in the first configuration, the first key has a first orientation relative to the second key, the first key first magnet is magnetically coupled to the second key first magnet, and the first key second magnet is magnetically coupled to the second key second magnet such that the first key is indexed and resists rotation away from the first orientation relative to the second key, wherein when the key set is in the second configuration, the first key has a second orientation relative to the second key and the first key first magnet and the first key second magnet are between the second key first magnet and the second key second magnet, and wherein when the key set is in the third configuration, the first key has a third orientation relative to the second key, the first key first magnet is magnetically coupled to the second key second magnet, and the first key second magnet is magnetically coupled to the second key first magnet such that the first key is indexed and resists rotation away from the third orientation relative to the second key.

20. The key set of claim 1, wherein the accessory comprises a pocket clip, a cutter, a tool, a light, an access fob, a writing instrument, a locator beacon, a radio frequency identification chip, a strap, a nail cleaner, a toothpick holder, a money clip, a bar, or a case.

21. The key set of claim 4, wherein the first key first magnet is closer to the second key blade when the key set is in the first configuration than when the key set is in the second configuration, and wherein the first key first magnet is closer to the second key blade when the key set is in the second configuration than when the key set is in the third configuration.

22. The key set of claim 19, wherein the first key blade is closer to the second key blade when the key set is in the first configuration than when the key set is in the second configuration, and wherein the first key blade is closer to the second key blade when the key set is in the second configuration than when the key set is in the third configuration.

* * * * *